US009247367B2

(12) United States Patent
Nobile et al.

(10) Patent No.: US 9,247,367 B2
(45) Date of Patent: Jan. 26, 2016

(54) MANAGEMENT SYSTEM WITH ACOUSTICAL MEASUREMENT FOR MONITORING NOISE LEVELS

(71) Applicants: Matthew A. Nobile, Poughkeepsie, NY (US); Sal M. Rosato, Pine Plains, NY (US)

(72) Inventors: Matthew A. Nobile, Poughkeepsie, NY (US); Sal M. Rosato, Pine Plains, NY (US)

(73) Assignee: International Business Machines Corporation, Armonk, NY (US)

( * ) Notice: Subject to any disclaimer, the term of this patent is extended or adjusted under 35 U.S.C. 154(b) by 404 days.

(21) Appl. No.: 13/664,851

(22) Filed: Oct. 31, 2012

(65) Prior Publication Data

US 2014/0119547 A1 May 1, 2014

(51) Int. Cl.
*H04R 29/00* (2006.01)

(52) U.S. Cl.
CPC ..... *H04R 29/005* (2013.01); *G10K 2210/12* (2013.01); *H04R 29/008* (2013.01); *H04R 2201/021* (2013.01)

(58) Field of Classification Search
CPC ..... H04R 29/005; H04R 2201/021; G10K 2210/12
USPC ..... 381/56, 58, 72, 111, 122; 340/539.26
See application file for complete search history.

(56) References Cited

U.S. PATENT DOCUMENTS 4,330,691 A * 5/1982 Gordon ..... H04R 1/02 181/144
4,881,135 A * 11/1989 Heilweil ..... 386/224
4,923,032 A * 5/1990 Nuernberger ..... H04R 1/025 181/141
6,845,161 B2 * 1/2005 Boss ..... 381/56
6,845,162 B1 * 1/2005 Emborg et al. ..... 381/71.4
7,092,853 B2 8/2006 Collier et al.
7,151,835 B2 12/2006 Yonovitz et al.
7,441,005 B2 * 10/2008 Matsunaga ..... 709/207
7,503,616 B2 * 3/2009 Linhard ..... B60R 11/02 296/211
7,761,544 B2 * 7/2010 Manasseh et al. ..... 709/223
8,330,817 B1 * 12/2012 Foster ..... G08B 13/19647 296/186.1
8,995,670 B2 * 3/2015 Lambert et al. ..... 381/56
2003/0120367 A1 * 6/2003 Chang et al. ..... 700/94
2005/0103133 A1 * 5/2005 Bizzotto et al. ..... 73/866.1
2005/0216114 A1 9/2005 Hsiung et al.
2007/0223533 A1 * 9/2007 Kirrmann et al. ..... 370/469
2009/0052677 A1 2/2009 Smith
2009/0091441 A1 * 4/2009 Schweitzer et al. ..... 340/531
2010/0079342 A1 4/2010 Smith et al.
2011/0082690 A1 * 4/2011 Togami et al. ..... 704/201
2011/0202396 A1 8/2011 Viveiros et al.
2011/0268282 A1 11/2011 Paige et al.
2013/0039497 A1 * 2/2013 Ramalho et al. ..... 381/56
2014/0010380 A1 * 1/2014 Usher et al. ..... 381/58
2014/0018097 A1 * 1/2014 Goldstein ..... 455/456.1

* cited by examiner

*Primary Examiner* — Davetta W Goins
*Assistant Examiner* — Daniel Sellers
(74) *Attorney, Agent, or Firm* — Cantor Colburn LLP; Margaret McNamara

(57) ABSTRACT

A system is provided and includes a plurality of acoustic devices disposed in locations arrayed throughout a defined space, each one of the plurality of acoustic devices being receptive of acoustical attributes such as sound or noise levels generated in the defined space and configured to issue signals reflective of the generated acoustical attributes and an acoustic data unit disposed in signal communication with each of the plurality of acoustic devices. The acoustic data unit is receptive of the signals issued from the plurality of acoustic devices and configured to convert the signals into digital acoustic data and to output the digital acoustic data in a serialized format compatible with a network protocol.

5 Claims, 3 Drawing Sheets

MANAGEMENT SYSTEM WITH ACOUSTICAL MEASUREMENT FOR MONITORING NOISE LEVELS

BACKGROUND

The embodiments described herein relate to management systems, and more specifically, to building management systems including acoustical measurement systems for monitoring noise levels.

Excessive noise in datacenters and other indoor spaces is becoming an increasing concern as increasingly powerful computing devices are coming on line. Generally, however, owners of datacenters are incapable of accurately measuring noise levels and then using those measurements to alert personnel or to make necessary changes.

In some previous solutions, microphone stands have been disposed throughout a given space to make acoustic measurements. These stands are typically cumbersome and tend to interfere with free movement of personnel and equipment. The microphones themselves are often expensive and easily damaged. In other solutions, an individual with a sound level meter has been tasked with testing sound levels around a space. This is expensive, time consuming and generally unreliable, and it does not provide continuous monitoring of the noise levels.

SUMMARY

According to one embodiment, a system is provided and includes a plurality of acoustic devices disposed in locations arrayed throughout a defined space, each one of the plurality of acoustical devices being receptive of acoustical attributes such as sound or noise levels generated in the defined space and configured to issue signals reflective of the generated acoustical attributes and an acoustic data unit disposed in signal communication with each of the plurality of acoustic devices. The acoustic data unit is receptive of the signals issued from the plurality of acoustic devices and configured to convert the signals into digital acoustic data and to output the digital acoustic data in a serialized format compatible with a network protocol.

According to another embodiment, a management system is provided and includes a process control system operating in accordance with a network protocol and an acoustic measurement system. The acoustic measurement system includes a plurality of acoustic devices disposed in locations arrayed throughout a defined space, each one of the plurality of acoustic devices being receptive of acoustical attributes such as sound or noise levels generated in the defined space and configured to issue signals reflective of the generated acoustical attributes and an acoustic data unit disposed in signal communication with each of the plurality of acoustic devices and the process control system. The acoustic data unit is receptive of the signals issued from the plurality of acoustic devices and configured to convert the signals into digital acoustic data and to output the digital acoustic data to the process control system in a serialized format compatible with the network protocol.

According to another embodiment, a method of measuring sound and noise in a defined space is provided and includes defining an array of locations throughout the defined space, disposing a plurality of acoustic devices in the defined locations, receiving, at an acoustic data unit, acoustic data from the plurality of acoustic devices and outputting, from the acoustic data unit, the acoustic data in a serialized format that is compatible with a network protocol.

Additional features and advantages are realized through the techniques of the present embodiments. Other embodiments and aspects are described in detail herein. For a better understanding of the embodiments with the advantages and the features, refer to the description and to the drawings.

BRIEF DESCRIPTION OF THE SEVERAL VIEWS OF THE DRAWINGS

The subject matter which is regarded as the embodiments is particularly pointed out and distinctly claimed in the claims at the conclusion of the specification. The forgoing and other features, and advantages of the embodiments are apparent from the following detailed description taken in conjunction with the accompanying drawings in which:

DETAILED DESCRIPTION

An array of microphones may be mounted in, for example, a ceiling of a data center or another type of indoor space or simply a defined space to be receptive of generated acoustical attributes, such as sound or noise levels. Auxiliary instrumentation is then provided to power the microphones, to perform analog/digital (A/D) conversion of signals generated by the microphones and to detect sound levels in and around each microphone in decibels (dBs). A network allows for the microphones to be networked with the auxiliary instrumentation and a general management system such that the microphones can be sequentially sampled so that their signals can be integrated to a process control system run by the management system. Thus, "real time" noise levels sensed by the microphones can be monitored and displayed and also "back propagated" to typical and specified ear-height locations throughout the space.

Figure 1:
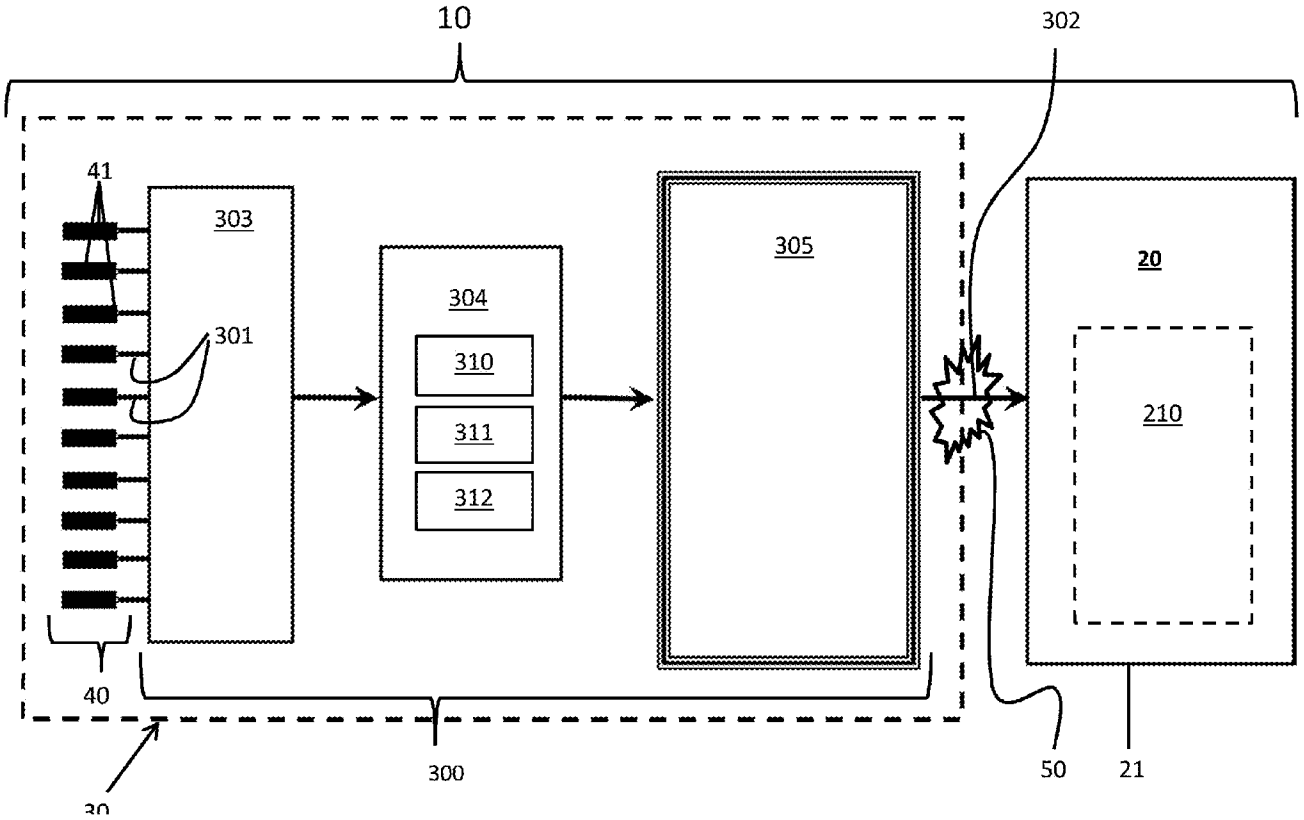
FIG. 1 is a schematic diagram of a building management system including an acoustical measurement system in accordance with embodiments.
Figure 2:
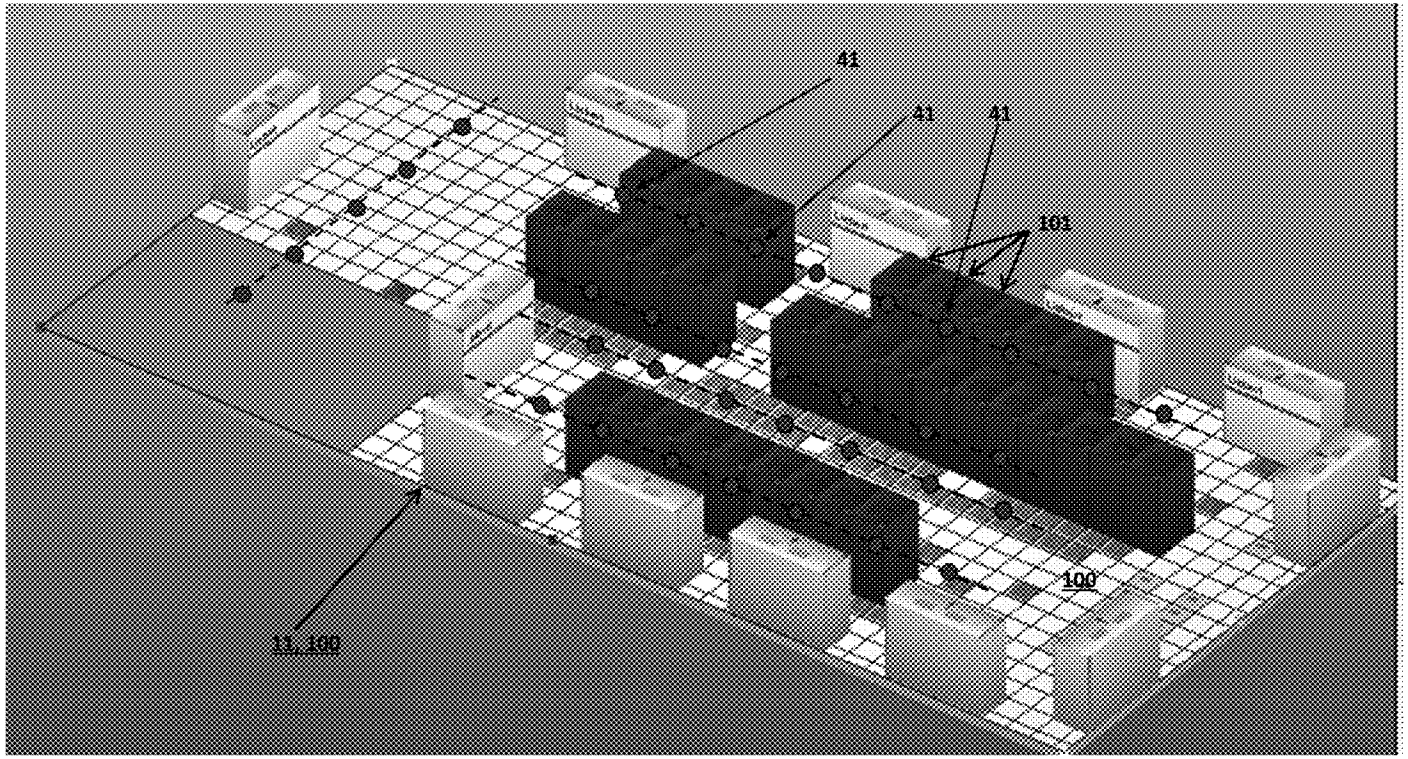
FIG. 2 is a perspective view of a plurality of acoustical devices of the acoustical measurement system in accordance with embodiments.

With reference to FIGS. 1 and 2, a management system 10 is provided for performing various types of condition measurements in a defined space 11. The defined space 11 may be an indoor space, such as a datacenter, or, in some cases, to an outdoor space with defined parameters. In either case, the defined space 11 may refer to a single defined space or to multiple defined spaces. In the latter instance, the defined space 11 may refer to an indoor space that is divided into multiple smaller indoor spaces, such as an office building with a plurality of offices.

For purposes of clarity and brevity, with reference to FIG. 2, the following description will relate to the exemplary case in which the defined space 11 relates to an indoor space for use as a datacenter 100. As shown, the datacenter 100 includes multiple computing devices 101 that are each configured to generate a given level of acoustical output (i.e., sound or noise) in accordance with currently running operations. This acoustical output may, at times, exceed certain limits. Thus, the acoustical output should be monitored as described below.

To this end, the management system 10 includes a process control system 20, an acoustical measurement system 30, a plurality of acoustical devices 40, which may be regarded as components of the acoustical measurement system, and one or more networks 50, which are configured to facilitate communication between the various features of the management system 10. The process control system 20 manages and controls various conditions within the defined space 11 and may be embodied as a central computer 21 (i.e., a personal computer or a server), which is either disposed on the premises or located remotely, and which may include a user interface 210. The user interface 210 permits review of digital acoustical data in a serialized format (to be described below) as well as issuance of alarms indicating threshold violations. The process control system 20 operates in accordance with a building management system (BMS) open communication protocol such as Modbus, BACnet, LONWORKS and/or open process control (OPC). As a general matter, the BMS operates in accordance with one or more standardized network protocols for process control systems.

As noted above, the acoustical measurement system 30 may include the plurality of acoustical devices 40 and an acoustical data unit 300. For the exemplary case where the defined space 11 is the datacenter 100 of FIG. 2, the plurality of acoustical devices 40 is disposed in the defined space 11 such that each acoustical device 40 is respectively disposed in a predefined corresponding location. The various locations for each of the plurality of acoustical devices 40 are arrayed throughout the defined space 11. In this way, each one of the plurality of acoustical devices 40 may be positioned to be receptive of sound or noise generated in the defined space 11. That is, individual acoustical device 41 may be positioned proximate to one of the computing devices 101 such that the acoustical output generated by the one computing device 101 is primarily picked up by the proximal individual acoustical device 41.

Figure 3:
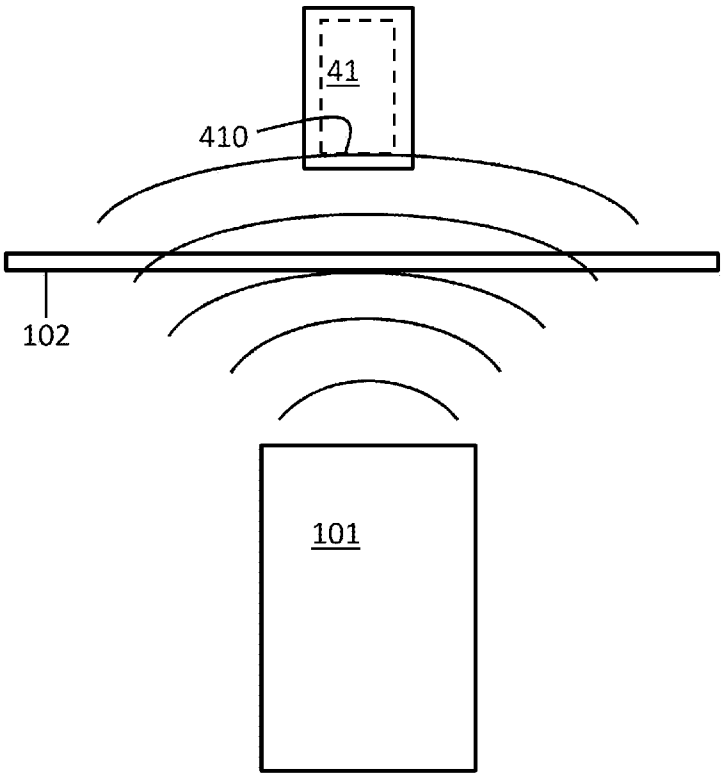
FIG. 3 is a plan view of an acoustical device disposed in a concealed location.

In accordance with embodiments and, with reference to FIG. 3, one or more individual acoustical devices 41 may be disposed in a concealed location. For the exemplary case where the defined space 11 is the datacenter 100 of FIG. 2, the individual acoustical devices 41 may be installed above and at a distance from an upper surface of a ceiling 102 of the datacenter 100. In this case, the acoustical output generated by one of the computing devices 101 is able to reach the proximal one of the individual acoustical devices 41 via the material of the ceiling 102. However, since the one of the individual acoustical devices 41 is disposed above the ceiling 102, it will not be revealed by casual observations of the datacenter 100.

As shown in FIG. 3, one or more of the individual acoustical devices 41 may include microphones 410. As such, acoustical and/or other vibratory signals are receivable by the individual acoustical devices 41. The individual acoustical devices 41 then convert the acoustical and/or other vibratory signals into analog acoustical signals that are reflective of the sound or noise generated and output by the computing devices 101.

As shown in FIG. 1, the individual acoustical devices 41 may be respectively coupled to the acoustical data unit 300 via wiring 301 or by way of wireless networking. Similarly, the acoustical data unit 300 may be coupled to the process control unit 20 via wiring 302 or by way of wireless networking. In any case, the acoustical data unit 300 is disposed in signal communication with each individual acoustical device 41 of the plurality of acoustical devices 40 and the process control system 20. The acoustical data unit 300 is thus receptive of the analog acoustical signals issued from each of the individual acoustical devices 41 of the plurality of acoustical devices 40. The acoustical data unit 300 is further configured to convert the received analog acoustical signals into digital acoustical data and to output the digital acoustical data to the process control system 20 in a serialized format that is compatible with a process control industry standard network protocol that will be monitored by the process control system 20.

In accordance with embodiments, the acoustical data unit 300 may include a multiplexer 303, which is coupled to each individual acoustical device 41 of the plurality of acoustical devices 40 to be receptive of the analog acoustical signals, an analog/digital (A/D) converter 304 and a processing unit 305. The A/D converter 304 is configured to convert the analog acoustical signals issued from the plurality of acoustical devices 40 and received by the multiplexer 303 into the digital acoustical data. In addition, the A/D converter may include a weighting element 310, a filtering element 311 and a calibration element 312. The processing unit 305 is configured to process the digital acoustical data and to organize the digital acoustical data in the serialized format compatible with the network protocol.

The weighting element 310 is configured to weight the analog acoustical signal from each one of the individual acoustical devices 41 over its frequency range and may do so by use of a standardized "A-weighting" curve. The filtering element 311 is configured to extract a mean-square level for each weighted analog acoustical signal and to convert the mean square level to logarithmic values (i.e., sound pressure levels which are given in decibels, a log quantity). The filtering element 311 or another element of the A/D converter 304 then digitizes the logarithmic values. The calibration element 312 is configured to include mathematical calculations to back-propagate the analog acoustical signals to give the levels at different points in space from where the individual acoustical devices 41 are located. This back-propagation can be selectively initiated or executed.

In accordance with embodiments, a "calibration" or "validation" procedure as executed by the calibration unit 312 may include periodic or non-periodic walk-through acoustical measurements within the defined space 11 with the results being stored. These measurements may be of the actual A-weighted sound pressure level (i.e., a one-number result in decibels) at ear-height positions to which the main measurements are being "back propagated." The walk-through measurements thus provide actual values in addition to predicted values and a matrix of "translation factors" is then generated and stored. These translation factors can then be employed to verify that the back-propagation is accurate or to adjust and "calibrate" the back-propagation calculations based on the walk-through measurements.

An output of the processing unit 305 is transmitted to the process control unit 20. The output may include a sequence of data including, for each individual acoustical device 41, an identification of a given individual acoustical device 41 (i.e., a unique address) and digital acoustical data associated with the given individual acoustical device 41. The digital acoustical data associated with each of the individual acoustical devices 41 may be, in accordance with some embodiments, a number representing the A-weighted sound pressure level at the particular ear-level position in the datacenter 100. This output is translated or encoded by the processing unit 305 into, for example, an open automation communications protocol.

The process control unit 20 may also be provided with high and low alarm threshold values that can be set automatically or by an administrator. Should any of the threshold values be violated by the digital acoustical data, a summary alarm function could be activated. In accordance with embodiments, the summary alarm functionality may have corresponding communications registers as well as a relay contact output as part of the noise monitoring system. The contact output could be tied to a BMS system as a digital input to provide alarm indication. The refresh rate of this system can provide real-time or near real-time sound/noise data to any BMS system.

In accordance with aspects and, as described above, a method of measuring sound or noise levels in a defined space is provided. The method includes defining an array of locations throughout the defined space, disposing a plurality of acoustical devices in the defined locations, receiving, at an acoustical data unit, acoustical data from the plurality of acoustical devices, and outputting, from the acoustical data unit, the acoustical data in a serialized format that is compatible with a network protocol. The method may further include coupling the acoustical data unit to a process control system operating in accordance with the network protocol such that the process control system is receptive of the acoustical data in the serialized format.

The terminology used herein is for the purpose of describing particular embodiments only and is not intended to be limiting of the embodiments. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one more other features, integers, steps, operations, element components, and/or groups thereof.

The corresponding structures, materials, acts, and equivalents of all means or step plus function elements in the claims below are intended to include any structure, material, or act for performing the function in combination with other claimed elements as specifically claimed. The description of the present embodiments has been presented for purposes of illustration and description, but is not intended to be exhaustive or limited to the embodiments in the form disclosed. Many modifications and variations will be apparent to those of ordinary skill in the art. The embodiments were chosen and described in order to best explain principles and their practical application, and to enable others of ordinary skill in the art to understand the embodiments with various modifications as are suited to the particular use contemplated.

While the preferred embodiments have been described, it will be understood that those skilled in the art, both now and in the future, may make various improvements and enhancements which fall within the scope of the claims which follow. These claims should be construed to maintain the proper protection for the embodiments first described.

What is claimed is:

1. A method of measuring acoustics in a defined space, comprising:

defining an array of concealed locations throughout the defined space;

concealing a plurality of acoustic devices in the defined concealed locations by disposing the acoustic devices above and at a distance from an upper surface of a ceiling having material through which acoustics pass to reach the acoustic devices;

receiving, at an acoustic data unit, acoustic data from the plurality of acoustic devices;

converting the acoustic data by back-propagating the acoustic data to a level associated with a different point in space from where the corresponding acoustic device is located and digitizing the back-propagated acoustic data; and outputting, from the acoustic data unit, the converted acoustic data in a serialized format that is compatible with a network protocol.

2. The method according to claim 1, further comprising coupling the acoustic data unit to a process control system operating in accordance with the network protocol such that the process control system is receptive of the converted acoustic data in the serialized format.

3. The method according to claim 1, further comprising:

multiplexing, at the acoustic data unit, the acoustic data from the plurality of acoustic devices;

converting analog signals from the plurality of acoustic devices to digital signals; and organizing the digital signals into the serialized format.

4. The method according to claim 3, wherein the converting comprises:

weighting the analog signal from each acoustic device over a frequency range thereof;

extracting a mean-square level for each weighted analog signal;

converting the mean-square level to logarithmic values;

digitizing the logarithmic values.

5. A method of measuring acoustics in a defined space, comprising:

concealing acoustic devices above and at a distance from an upper surface of a ceiling in the defined space such that acoustics pass through ceiling material to reach the acoustic devices;

receiving analog acoustic data reflective of the acoustics passing through the ceiling material from each acoustic device;

back-propagating the analog acoustic data for each acoustic device to a level associated with a different point in space from where the corresponding acoustic device is located;

converting the back-propagated, analog acoustic data into digitized data; and outputting, in a serialized format compatible with a network protocol, the digitized data for each acoustic device in a sequence including, for each acoustic device, the digitized data and an identification of the corresponding acoustic device.

* * * * *